US009312612B2

(12) United States Patent
Paulus et al.

(10) Patent No.: US 9,312,612 B2
(45) Date of Patent: Apr. 12, 2016

(54) VARIABLE IMPEDANCE COAXIAL CONNECTOR INTERFACE DEVICE

(71) Applicant: Corning Optical Communications RF LLC, Glendale, AZ (US)

(72) Inventors: Eric James Paulus, Phoenix, AZ (US); Jeevan Kumar Vemagiri, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/531,254

(22) Filed: Nov. 3, 2014

(65) Prior Publication Data

US 2015/0050834 A1 Feb. 19, 2015

Related U.S. Application Data

(63) Continuation of application No. 13/495,298, filed on Jun. 13, 2012, now Pat. No. 8,979,581.

(51) Int. Cl.

| | |
|---|---|
| ***H01R 9/05*** | (2006.01) |
| ***H01R 24/44*** | (2011.01) |
| ***H01R 13/66*** | (2006.01) |

(52) U.S. Cl.

CPC ..... *H01R 9/0515* (2013.01); *H01R 9/05* (2013.01); *H01R 13/6608* (2013.01); *H01R 24/44* (2013.01)

(58) Field of Classification Search

CPC .. H01R 2103/00; H01R 24/40; H01R 9/0521; H01R 9/0524; H01R 9/0518

USPC ..... 439/578, 675

See application file for complete search history.

(56) References Cited

U.S. PATENT DOCUMENTS

| | | | | |
|---|---|---|---|---|
| 5,563,562 | A | 10/1996 | Szwec | |
| 5,906,511 | A * | 5/1999 | Bozzer et al. | 439/579 |
| 6,302,701 | B1 | 10/2001 | Miller, Jr. et al. | |
| 6,663,424 | B1 | 12/2003 | Wyse et al. | |
| 7,442,080 | B1 | 10/2008 | Tsen | |

(Continued)

FOREIGN PATENT DOCUMENTS

WO 2004/008583 A1 1/2004

OTHER PUBLICATIONS

Chenkin, dc to 40 GHz Coaxial-to-Microstrip Transition for 100-um-Thick GaAs Substrates; IEEE Transactions on Microwave Theory and Techniques, vol. 37, No. 7, p. 1147-1150, Jul. 1989.

(Continued)

*Primary Examiner* — Phuong Dinh

(74) *Attorney, Agent, or Firm* — Harness, Dickey & Pierce, P.L.C.

(57) ABSTRACT

A variable impedance interface device connecting a coaxial connector to an external component with a housing having a first end adapted to receive a coaxial connector and a second end having an interface where the housing is attachable to an external component, such as a printed circuit board. A cavity within the housing is defined by an inner surface and has a cavity first end and a cavity second end. The inner surface tapers between the cavity first end and the cavity second end. A mating position in the cavity has a certain dimension due to the taper of the inner surface, and defines a location at which a coaxial connector received by the housing positions. An impedance of the housing is based on the mating position and may be varied due to the impedance of the interface such that signal degradation at the interface is reduced.

17 Claims, 7 Drawing Sheets

(56) References Cited

U.S. PATENT DOCUMENTS

| | | | | |
|---|---|---|---|---|
| 7,500,873 | B1 * | 3/2009 | Hart | 439/578 |
| 7,808,341 | B2 | 10/2010 | Aguirre | |
| 2008/0200068 | A1 | 8/2008 | Aguirre | |

OTHER PUBLICATIONS

Eisenhart, A Better Mlcrostrip Connetor; CH1355—Jul. 1978; p. 218-320.

Cheng et al.; Improving the High-Frequency Performance of Coaxial-to-Microstrip Transitions; IEEE vol. 59, No. 6, p. 1468-1477, Jun. 2011.

England, A Coaxial to Microstrip Transition; IEEE, Jan. 1976; p. 47-48.

* cited by examiner

VARIABLE IMPEDANCE COAXIAL CONNECTOR INTERFACE DEVICE

CROSS-REFERENCE TO RELATED APPLICATION

This application is a continuation of U.S. patent application Ser. No. 13/495,298 filed on Jun. 13, 2012, entitled: "A Variable Impedance Coaxial Connector Interface Device", the disclosure of which is incorporated herein by reference.

BACKGROUND

1. Field of the Disclosure

The technology of the disclosure relates generally to coaxial connectors, and particularly to a coaxial connector interface device that provides an interface connection between a component and a coaxial connector and has variable impedance characteristics to accommodate the difference between the impedance of the connector and the impedance of the component to reduce signal degradation 2. Technical Background RF Connectors play a very important part in the power transfer efficiency in any electrical system. RF connectors are the link between the electrical signal generators, signal transmission lines and electrical loads. All the electrical sources, signal transmission lines and electrical loads, including the RF connectors, are designed to have fixed impedance such as 50 ohms to eliminate or at least minimize the reflection losses due to impedance change or discontinuity. Traditional 50 ohm connectors, male-male, male-female and female-female, are 50 ohms at their interface and very close to 50 ohms throughout their length.

It is possible to maintain a 50 ohm impedance at a single discrete cross-section within a RF connector, but it is more challenging to maintain a 50 ohm impedance throughout the length of the RF connector. This is especially true for complex RF connectors, such as push-on type connectors, which have entirely different connector locking technology compared to the traditional screw type locking technology. Also, a challenge in the connector design is to maintain a 50 ohm impedance in the right angled connectors, especially at higher frequency ranges, greater than 20 GHz. The impedance discontinuity challenge also is prevalent outside a single connector body and in the interface regions of a male-female interface and also the interface between a male coaxial connector and a printed circuit board (PCB). While the impedance discontinuity in the push-on male-female interface arises due to a potential loose connection between male and female, even in a full-detent type interface, the discontinuity in the male coaxial connector to external PCB arises due to the imperfection in and the bandwidth of the coaxial to PCB signal line (such as coplanar waveguide (CPW), Grounded CPW, Microstrip etc.) transition design.

SUMMARY

Embodiments disclosed herein include a variable impedance interface device for connecting a coaxial connector to an external component. The interface device has a housing with a first end adapted to receive a coaxial connector and a second end having an interface where the housing is attachable to an external component. A cavity in the housing is defined by an inner surface which extends from the first end to the second end. The housing has an opening for receiving a coaxial connector into the cavity. A cavity first end has a first diameter a cavity second end has a second diameter. The inner surface tapers radially inwardly between the cavity first end and the cavity second end. A center conductor extends into the housing from the second end toward the first end and into the cavity. The center conductor is electrically insulated from the housing by a dielectric. A mating position in the cavity has a certain dimension due to the taper of the inner surface. The mating position defines a location at which the coaxial connector received by the housing positions. An impedance of the housing is based on the mating position and may be varied due to the impedance of the interface such that signal degradation at the interface is reduced.

The impedance of the housing varies based on one or more of the location of the mating position, the dimension of the mating position, the dimension may be a diameter, the diameter of the center conductor, the diameter of the dielectric, and the material composing the dielectric. The dielectric may be composed of one or more of air, Teflon®, Torlon® or glass. There may be a plurality of mating positions with the housing having different impedances at each of the plurality of mating positions. The mating position may have a structural feature. The structural feature may be at least one groove extending radially outwardly from the inner surface of the cavity. The housing may have a first groove and a second groove with the housing having a first impedances at the first groove and a second impedance at the second groove.

In another embodiment, a variable impedance connector interface assembly is disclosed. An interface device having a shroud with an outer surface, a front end, an opening extending into the shroud from the front end and having a central conductor extending from a back end of the opening towards the front end, the opening having an inner surface with a first groove having a first diameter and a second groove having a second diameter, the first groove disposed between the second groove and the front end and the central conductor extending beyond the first groove, and a female connector with an outer surface, a front end, and an opening to frictionally receive the central conductor of the shroud, the front end having a radially outward extending projection to engage the first and second grooves in the opening of the shroud.

In some embodiments, the connector has a first impedance at the first groove and a second impedance at the second groove, the first impedance being larger than the second impedance.

In other embodiments, the connector has a first impedance at the first groove and a second impedance at the second groove, the first impedance being smaller than the second impedance.

In some embodiments, the female connector has a second radially outward extending projection to engage the internal surface of the opening in the shroud.

Additional features and advantages will be set forth in the detailed description which follows, and in part will be readily apparent to those skilled in the art from that description or recognized by practicing the embodiments as described herein, including the detailed description, which follows, the claims, as well as the appended drawings.

It is to be understood that both the foregoing general description and the following detailed description are intended to provide an overview or framework for understanding the nature and character of disclosure. The accompanying drawings are included to provide a further understanding and are incorporated into and constitute a part of this specification. The drawings illustrate various embodiments and, together with the description, serve to explain the principles and operations of the concepts disclosed.

DETAILED DESCRIPTION

Figure 1:
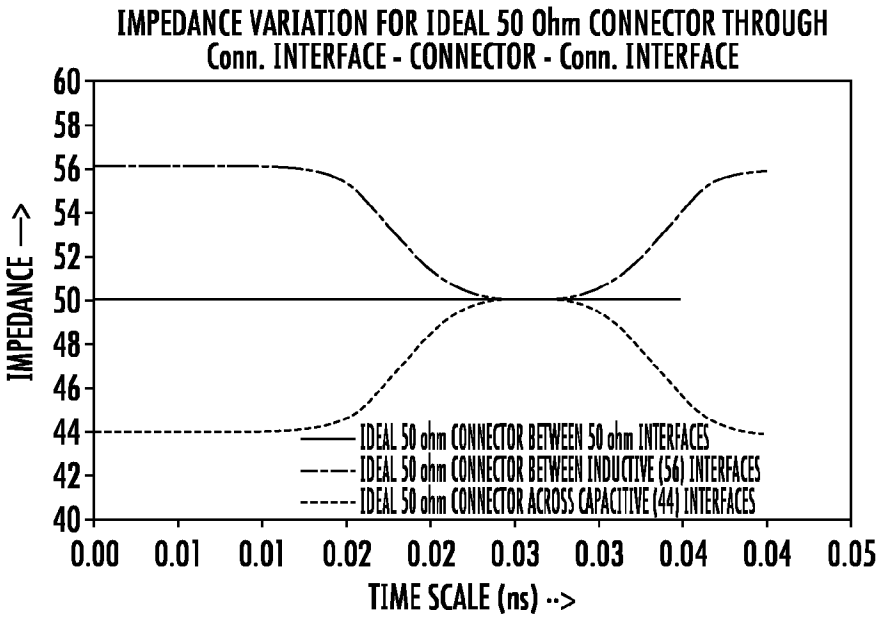
FIG. 1 is a graph illustrating a simulation of a Time Domain Reflectometry (TDR) sampling of a 50 ohm connector sandwiched between 56 ohm inductive interfaces and the case and a 44 ohm capacitive interfaces in prior art connectors.

Reference will now be made in detail to embodiment(s), examples of which are illustrated in the accompanying drawings, in which some, but not all embodiments are shown. Indeed, the concepts may be embodied in many different forms and should not be construed as limiting herein; rather, these embodiments are provided so that this disclosure will satisfy applicable legal requirements. Whenever possible, the same reference numerals will be used throughout the drawings to refer to the same or like parts.

Figure 2:
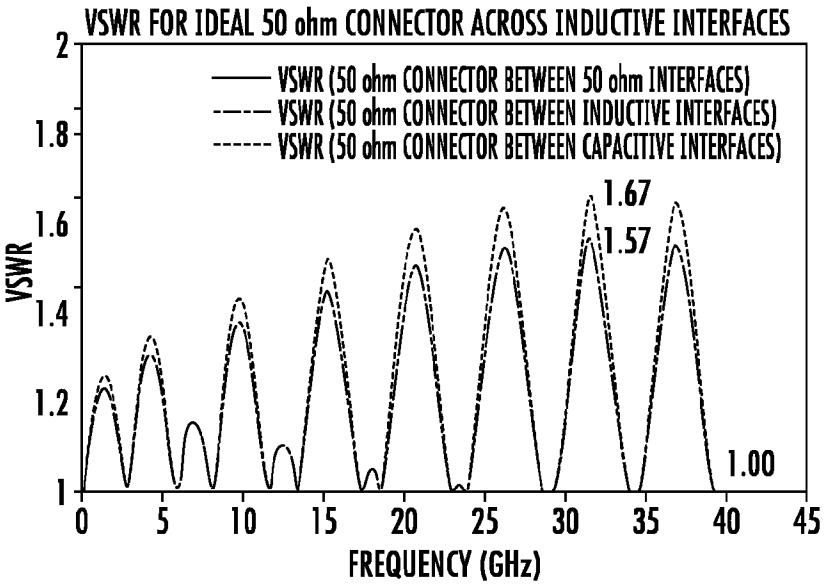
FIG. 2 is a graph illustrating the effect of the interfaces on the voltage standing wave ratio (VSWR) of the simulated connectors.

Impedance between a 50 ohm coaxial cable connector and a component to which it is connected, for example, a printed circuit board (PCB), can deviate by up to +/−4 or 5 ohms or possibly more depending on whether the component is inductive or capacitive with respect to the connector. The impedance difference at the interface between the component and the connector can result in signal loss due to the signal reflection even when the connector maintains 50 ohms throughout its length. FIGS. 1 and 2 illustrate simulated Time Delay Reflectometry (TDR) and VSWR (voltage standing wave ratio) plots, respectively, of a 50 ohm connector sandwiched between a 56 ohm inductive interface and a 44 ohm capacitive interface. The plots illustrate the TDR and VSWR that would result if the connector is connected on one end to a component that has such inductive characteristic, and on the other end to a component that has such capacitive characteristic. Both the resulting inductive and capacitive interfaces will increase the VSWR at the interface and cause degradation of the signal passing through the interfaces. As illustrated in FIG. 2, the VSWR is increased to 1.57 and 1.67 respectively for the inductive or capacitive interfaces of a standard 50 ohm connector. Thus, limiting the differences in impedance between the connector and the component (whether inductive or capacitive), will improve signal transmission through the interface. Interposing between the connector and the component an interface device that accommodates for the differences in impedances will achieve such improved signal transmission.

In this regard, embodiments presented herein are of variable impedance coaxial connector interface devices which provide a connection for a coaxial cable terminated with a coaxial cable connector to a component, such as, for example, a printed circuit board. The interface device may be constructed with variable impedance characteristics to accommodate for inductive or capacitive components. The multiple impedance characteristics are determined by certain dimensional aspects of the interface device, including, without limitation, its structure and constituent parts. In this way, one or more pre-determined impedance characteristics may be designed into the interface device.

Figure 3:
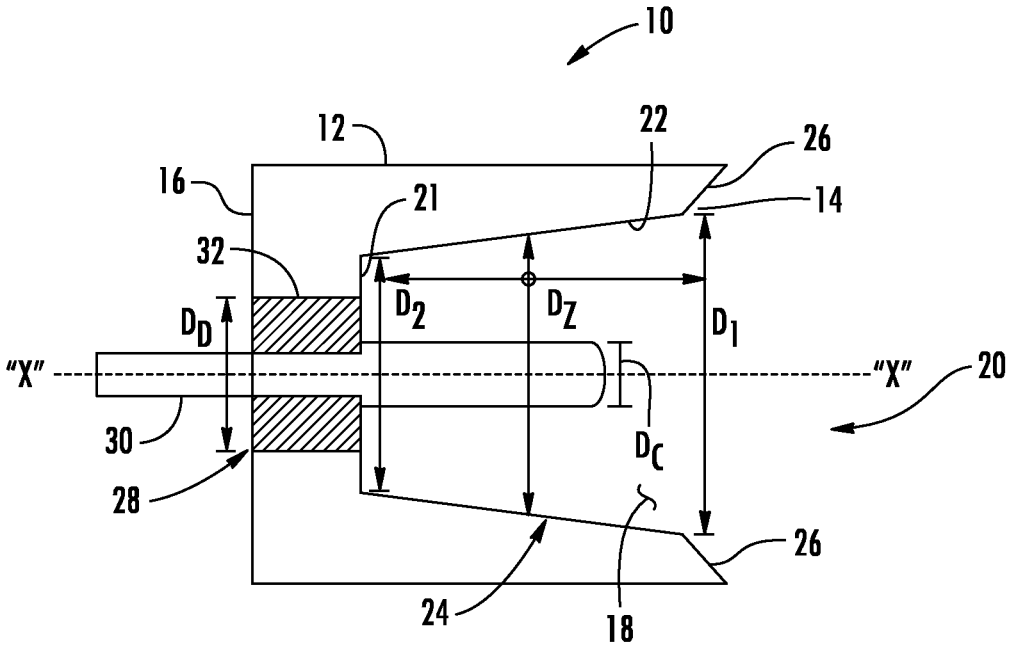
FIG. 3 is a partial cross section of an exemplary embodiment of a variable impedance coaxial connector interface device.

FIG. 3 illustrates an embodiment of a variable impedance coaxial connector interface device 10. The interface device 10 illustrated in FIG. 3 is in the form of a male shroud having a housing 12 with a first end 14 and a second end 16. The housing 12 has a cavity 18 having a cavity first end 19 at the first end 14 and a cavity second end 21 toward the second end 16. An opening 20 into the cavity 18 is located proximate or at the cavity first end 21. The cavity 18 may be defined by an inner surface 22 that slopes or tapers radially from the cavity first end 19 toward the cavity second end 21. In this regard, the inner surface 22 has a diameter D1 at the cavity first end 19 and a diameter D2 at the cavity second end 21, with a diameter $D_Z$ that varies, getting smaller toward the cavity second end 21. Locations in the cavity 18 provide mating positions 24 at which a coaxial connector (not shown in FIG. 3) may be mated with the interface device 10, for example, to connect a coaxial cable to the interface device 10. Because the inner surface 22 is sloped or tapered, the inner surface 22 provides multiple mating positions 24 between the cavity first end 19 and the cavity second end 21. Each mating position 24 has a respective diameter $D_Z$. Additionally, in the case where the mating position 24 is at the cavity first end 19, diameter $D_Z$ may equal D1. Similarly, in the case where the mating position 24 is located toward the cavity second end 21, the diameter $D_Z$ may equal D2. In addition to being sloped or tapered, the inner surface 22 may be substantially smooth as shown in FIG. 3 or may have a structural feature or design at a mating position 24. As a non-limiting example, the structural feature at the mating position 24 may be a groove, or any other feature, design, type or means of releasably retaining the coaxial connector in the mating position 24. In the case of the mating position 24 being or including a groove, the groove may extend radially outwardly from the inner surface 22. The groove may be axially positioned in the housing 12 along the longitudinal axis X and have the diameter $D_Z$. The housing 12 may have chamfered ends 26 at the opening 20. In this way, the opening 20 may accept and direct the end of a coaxial connector (not shown in FIG. 3) into the cavity 18. The coaxial connector may insert into and through the cavity 18 extending to the mating position 24 which defines a location at which the coaxial connector received by the housing location may position. Accordingly, the mating position 24 may be any point or location in, on and/or at the interface device 10 whether or not there is a structural feature at such point or location in the cavity 18 or inner surface 22.

The second end 16 of the housing 12 is adapted to attach to an external component, as a non-limiting example, a printed circuit board (PCB) (not shown in FIG. 3), with an interface 28 between the housing 12 and the external component. A center conductor 30 having a diameter $D_C$ extends into the housing 12 from the second end 16 generally along the longitudinal axis X of the housing 12. The center conductor 30 may extend toward the first end 14 and into a portion of the cavity 18. The center conductor 30 is insulated from the housing by dielectric 32 having a diameter $D_D$. The dielectric 32 may be composed or constructed of any appropriate material, including, as non-limiting examples, air, teflon, torlon and/or glass, or combinations thereof. Additionally, the dielectric 32 may support the center conductor 30 in the housing 12. At the second end 16, the center conductor 30 may attach to a conductive element of the external component, such as a trace on the printed circuit board, or other conductive element.

Figure 4:
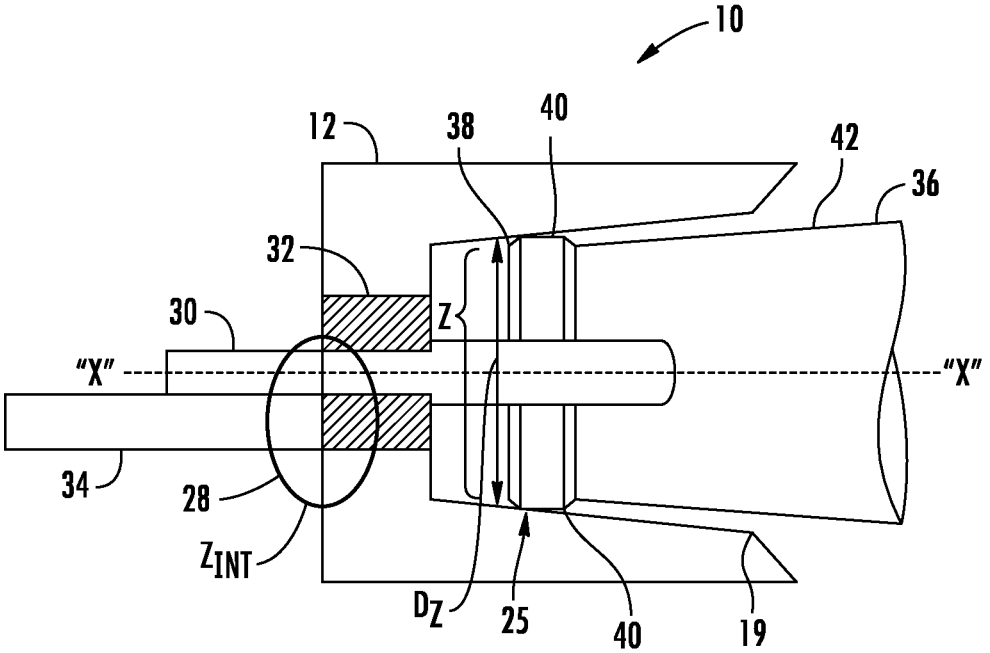
FIG. 4 is a partial cross section of the interface device of FIG. 3 with a coaxial connector engaged therewith.

Referring now to FIG. 4, there is shown the interface device 10 connected to an external component in the form of a PCB 34. A coaxial connector 36 is inserted in the housing 12, with the front end 38 of the coaxial connector 36 positioned at the mating position 24. The coaxial connector 36 is shown as a push-on type of connector with a compressible front end 38 such that when the coaxial connector 36 is inserted into the housing 12 at the opening 20, the front end 38 may compress to fit within the inner surface 22 of the cavity 18. As the coaxial connector 36 is advanced in the cavity 18 the front end 38 continues to be compressed by the inner surface 22 of the cavity 18 due to its slope or taper until the front end 38 reaches the mating position 24. When the front end 38 reaches the mating position 24, the front end 38 has been compressed to a diameter $D_Z$. In the case where inner surface 22 has a groove at the mating position 24, a radially outward projection 40 of the front end 38 positions in the groove such that the front end 38 is releasably retained by the groove. Additionally, an interface device 10 may be designed to have more than one groove at different mating positions. FIGS. 5, 6, 9, 10 and 13 illustrate an inner surface 22 with one or more grooves. In the case of the interface device 10 having more than one groove, the front end 38 would initially position in the first groove closest to the first end 20. Continuing to advance the coaxial connector 36 in the cavity 22 will cause the front end 38 to release from the groove closest to the first end 20 and then advance to the next groove further from the first end 20 and position in and be releasably retained by that groove. In this way, the front end 38 may be positioned in any of the grooves in the interface device 10. This is shown and discussed in more detail with respect to FIGS. 5 and 6 below. Additionally, due to the structure of the cavity 18 and/or the inner surface 22, the cavity 18 with the inner surface 22 allows for a certain amount of axial misalignment between the front end 38 of the coaxial connector 36 and the cavity second end 21 without affecting the electrical performance of the interface device 10 and the coaxial connector 36.

Although not shown in FIG. 4, the center conductor 30 will be electrically and physically connected with the inner conductor of the coaxial connector. Similarly, an outer surface 42 of the coaxial connector 36 will be electrically and physically connected to the housing 12. In this way, an electrical and mechanical connection is completed between the coaxial connector 36 and the PCB 34 via or through the interface device 10. Additionally, the diameter $D_Z$ will be the outer diameter of the outer conductor of the coaxial connector 36 at the front end 38. The diameter $D_Z$ will reflect the amount of compression of the front end 38 at the mating position 24.

The housing 12, and, thereby, the interface device 10 has an impedance Z at the mating position 24. The impedance Z is a result of one or more of a dimension of the mating position 24, for example, the diameter $D_Z$, the diameter of the center conductor $D_C$, the diameter of the dielectric $D_D$, or the dielectric material, or combinations thereof. In this way, if the coaxial connector 36 is located at a different mating position 24, either closer to the cavity first end 21 or closer to the cavity second end 21, the mating position 24 may have a different diameter $D_Z$ due to the slope or taper of the inner surface 22 and, therefore, a different impedance Z. Additionally, if the dielectric is constructed of a different material or combination of materials and/or has a different diameter $D_D$, the impedance Z of the mating position 24 may be different. In this way, the interface device 10 has variable impedance characteristics. The interface device 10 may be designed to provide a pre-determined impedance or impedances Z to coordinate with impedance $Z_{INT}$ of the interface between the interface device 10 and the PCB 34 to limit the impedance difference between the coaxial connector 36 and the interface 28 with the PCB, the external component 34. In this way, the interface device 10 may be designed to reduce signal degradation between the coaxial connector 36 and the external component 34. As non-limiting examples, an interface device 10 with a center conductor diameter $D_C$ of 0.015 inch, and a mating position diameter $D_Z$ of 0.0376 inch, the resulting Z is 55 ohms. If $D_Z$ was 0.037 inch, then Z would be 54 ohms. Additionally, a diameter $D_Z$ of 0.0346 inch may result in a Z of 50 ohms. In the above examples, the dielectric 32 is air. Thus, the structure and design of the interface device 10 may not only provide for multiple pre-determined impedance characteristics, but also may releasably retain the coaxial connector in the mating positions that provide for such pre-determined impedance characteristics to allow for appropriate signal transmission given the impedance of the external component.

Figure 6:
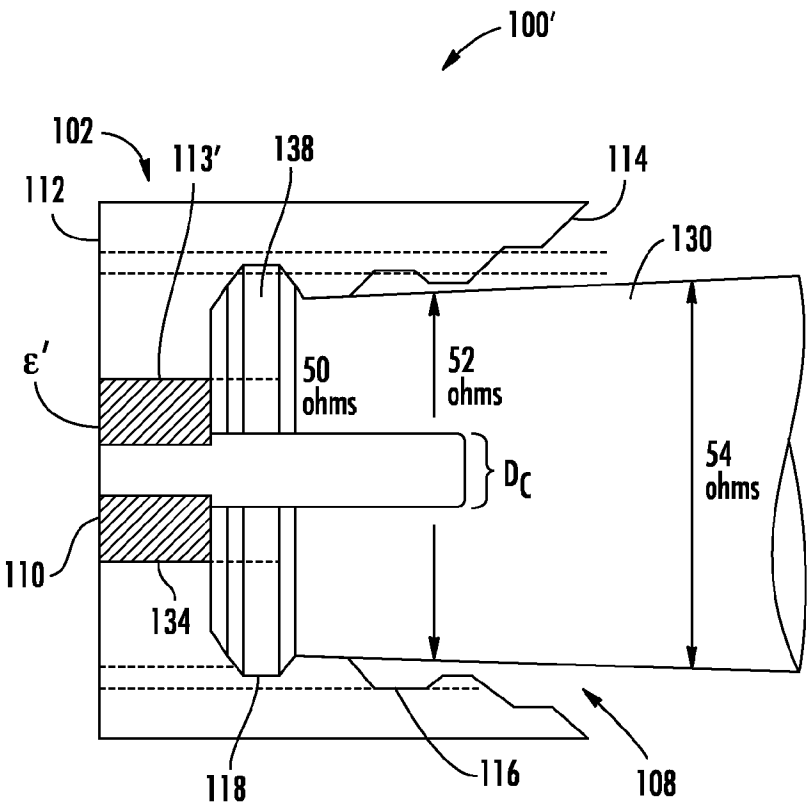
FIG. 6 is a partial cross section view of the variable impedance coaxial connector interface device according to an exemplary embodiment with a coaxial connector in a second engaged position.
Figure 5:
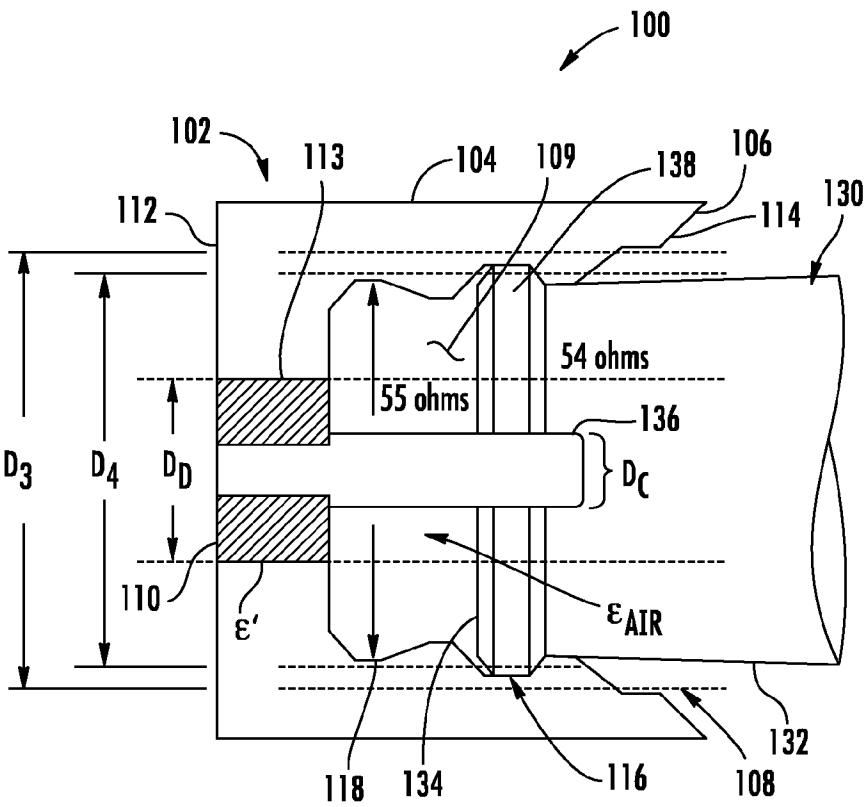
FIG. 5 is a partial cross section view of a variable impedance coaxial connector interface device according to an exemplary embodiment with a coaxial connector in a first engaged position in an inductive mode.

FIGS. 5 and 6 illustrate embodiments of a variable impedance interface devices 100, 100'. The interface devices 100, 100' have a housing in the form of a male shroud 102 with an outer surface 104, a first end 106, an opening 108 extending into a cavity 109 in the shroud 102 from the first end 106. A central conductor 110 extends from a second end 112 of the male shroud 102 towards the first end 106. The cavity 109 also has an inner surface 114 with a first mating position in the form of a first groove 116 having a first diameter D3 and a second mating position in the form of a second groove 118 having a second diameter D4. The first groove 116 is disposed between the second groove 118 and the first end 106. The central conductor 110 extends from the second end 112 and beyond the first groove 116. The only difference between the interface device 100 and interface device 100' is a dielectric 113, 113' respectively. Dielectric 113 is constructed of a material that has an electrical permittivity $\in$ of 2.1, and dielectric 113' has an electrical permittivity ∈' of 1.67. Otherwise the structure and design of the interface devices 100 and 100' are the same.

In FIGS. 5 and 6, the interface devices 100, 100' are shown in an assembly having a coaxial connector 130 inserted therein. The coaxial connector 130 has an outer surface 132, a front end 134, and an opening 136 to frictionally receive the central conductor 110 of the shroud 102. The front end 134 of the coaxial connector 130 has a radially outward extending projection 138 to engage and be releasably retained at one of the first or second grooves 116, 118 in the cavity 109 of the shroud 102. It should be noted that the coaxial connector 130 may have cantilevered fingers at the front end 134 that allow for resilient compression and bias outward toward the inner surface 114.

As illustrated in FIG. 5, the coaxial connector 130 has been inserted into the cavity 109 through the opening 108 of the shroud 102 of interface device 100 and is disposed in and releasably retained by the first groove 116. In this configuration, the interface device 100 is a slightly inductive interface given that the impedance at the first groove 116 is at 54 ohms. Additionally, the impedance at the second groove 118 is at 55 ohms. This inductive mode may be used to address the situation that may occur when the interface device 100 is connected to an inductive PCB interface or when there are connection issues between the central conductor and the coaxial connector in a typical connector interface. With the front end 134 of the coaxial connector 130 connecting to the shroud 102 in the first groove 116, there is sufficient mechanical locking of the coaxial connector 130 in the shroud 102 and a smooth impedance taper within the interface device 100 due to the taper or slope of the inner surface 114.

In FIG. 6, the coaxial connector 130 has been inserted into the cavity 109 through the opening 108 of the shroud 102 of interface device 100' and engages and is releasably retained by the second groove 118. In this mode, the impedance at the second groove is 50 ohms, while the impedance increases slightly (first to 52 and then 54 ohms) farther away from the front and 134.

Figure 5A:
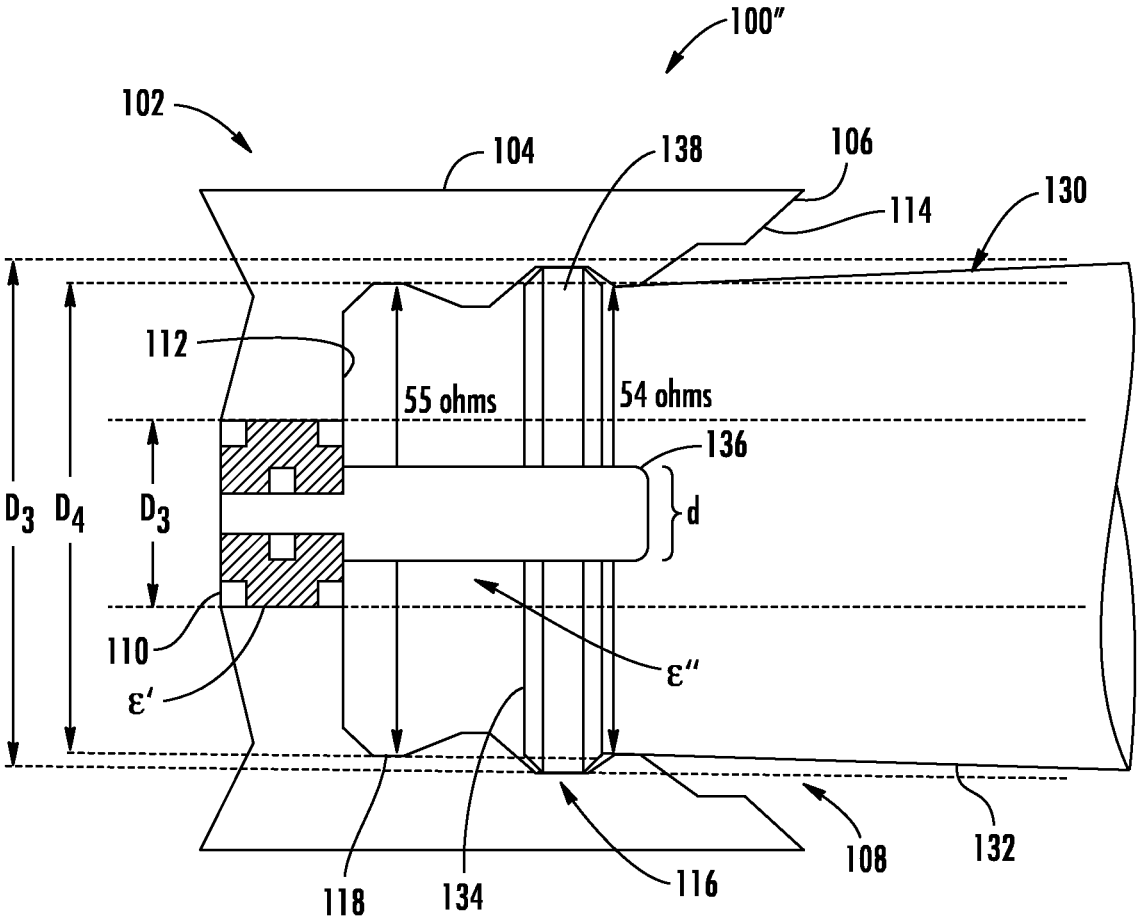
FIG. 5A is a partial cross section of the variable impedance coaxial connector interface device of FIG. 5 except with a different dielectric.

As is clear in FIGS. 5 and 6, the diameter D3 of the first groove 116 is larger than the diameter D4 of the second groove 118. The variations in the diameters of the grooves 116, 118 and/or the difference in electrical permittivity of the dielectrics 113, 113' will change the impedance of the interface device 100, 100' and, thereby, the coaxial connector 130 at those points. Additionally, the dielectric may be constructed of a combination of different materials with different electrical permittivity ratings resulting in a dielectric with an effective electrical permittivity different than individual dielectric material electrical permittivity ratings. As a non-limiting example, the dielectric may be formed with slots, holes and/or other types of perforations or apertures creating portions or areas of or in the dielectric material with the electrical permittivity of air ξair of 1.00. In this way the effective electrical permittivity of the dielectric may be adjusted. In this regard, FIG. 5A illustrates interface device 100" which is the same as interface device 100 of FIG. 5 except with a dielectric 115 having air-filled slots 117 formed therein. Although the dielectric material has an electric permittivity ∈ of 2.00, the dielectric has an effective electrical permittivity ∈eff of 1.67 due to the electrical permittivity fair of 1.00 of the air-filled slots 117. In this way, the dielectric, and, thereby, the interface device 100", may be further custom designed by forming the dielectric material with the appropriate amount, size, etc. of air-filled slots or other types of holes, perforations or apertures.

Figure 7:
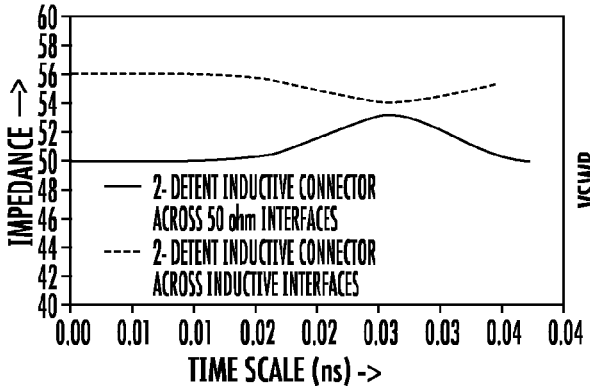
FIG. 7 is a graph illustrating a simulation of a TDR sampling for the connector interface across 50 ohm and inductive interfaces, such as that of FIGS. 5 and 6.
Figure 8:
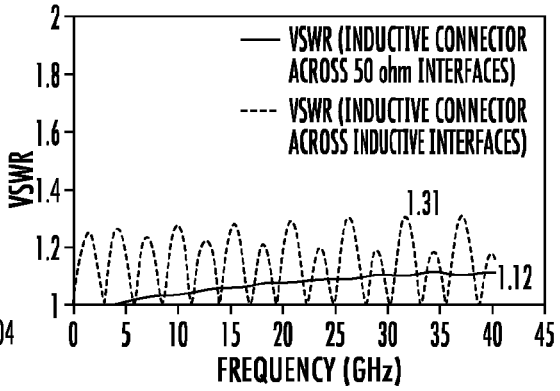
FIG. 8 is a graph illustrating the effect of the interfaces in FIG. 7 on the VSWRs.

FIG. 8 illustrates the projected improvement of VSWR from 1.57 (in FIG. 2) to 1.31 using an interface device such as 100 for inductive interfaces having an impedance variation within the interface device as shown by the TDR impedance (upper) profile in FIG. 7.

FIG. 8 also illustrates the projected VSWR result of 1.12 at 40 GHz when an interface device such as 100' is employed to mate with 50 ohm interfaces having an impedance variation within the connector interface as shown by the TDR impedance (lower) profile in FIG. 7.

Figure 9:
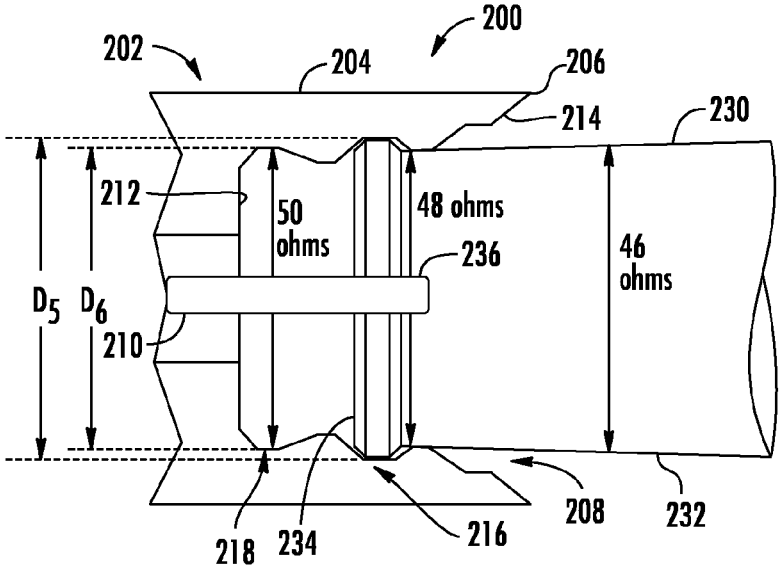
FIG. 9 is a partial cross section view of a variable impedance coaxial connector interface device according to an exemplary embodiment in a 50 ohm mode.

Another variable impedance interface device 200 is illustrated in FIG. 9. The interface device 200 has a male shroud 202 with an outer surface 204, a first end 206, an opening 208 extending into a cavity 209 in the shroud 202 from the first end 206. A central conductor 210 extends from a cavity second end 212 of the shroud 202 towards the first end 206. The cavity 209 also has an inner surface 214 with a first groove 216 having a first diameter D5 and a second groove 218 having a second diameter D6. The first groove 216 is disposed between the second groove 218 and the first end 206. The central conductor 210 extends from the second end 212 and beyond the first groove 216.

In FIG. 9, the interface device 200 is shown in an assembly with a coaxial connector 230 inserted therein. The coaxial connector 230 has an outer surface 232, a front end 234, and an opening 236 to frictionally receive the central conductor 210 of the shroud 202. The front end 234 of the coaxial connector 230 has a radially outward extending projection 238 to engage the first and second grooves 216, 218 in the cavity 209 of the shroud 202.

As illustrated in FIG. 9, the coaxial connector 230 has been inserted into the cavity 209 through the opening 208 of the shroud 202 and is disposed in and releasably retained by the first groove 216. In this configuration, the interface device 200 is slightly capacitive given that the impedance at the second groove 218 is at 50 ohms and at the first groove 216 is it 48 ohms. In this capacitive mode, the front end 234 of the coaxial connector 230 connects to the shroud 202 in the first groove 216, providing sufficient mechanical connection with the female connector 230 in the shroud 202 to releasably retain the female connector 230 in the interface device 200 and a very smooth impedance taper due to the taper of the inner surface 214 within the connector interface 200 as described below with respect to FIGS. 11 and 12.

Figure 10:
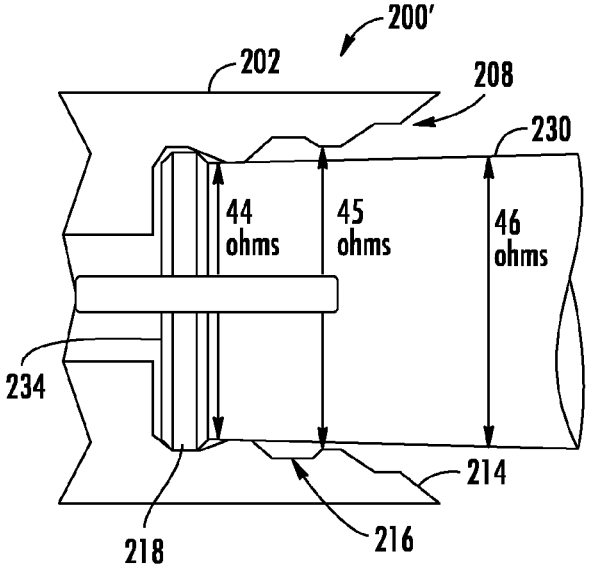
FIG. 10 is a partial cross section view of the variable impedance coaxial connector of FIG. 9 with the coaxial connector in a second position (capacitive mode)

In FIG. 10, the coaxial connector 230 has been inserted into the cavity 209 of the opening 208 of the shroud 202 of the interface device 200' and engages and is releasably retained by the second groove 218. In this mode, the impedance at the second groove 218 is 44 ohms, while the impedance increases very slightly (first to 45 and then 46 ohms) farther away from the front and 234. It should be noted that the coaxial connector 230 may also have cantilevered fingers at the front end 234 that allow for resilient compression and bias outward toward the internal surface 214.

As is clear in FIGS. 9 and 10, the diameter D5 of the first groove 216 is larger than the diameter D6 of the second groove 218. The variations in the diameters of the grooves 216, 218 will change the impedance of the interface devices 200, 200' and, thereby, the coaxial connector 230 at those points.

Figure 11:
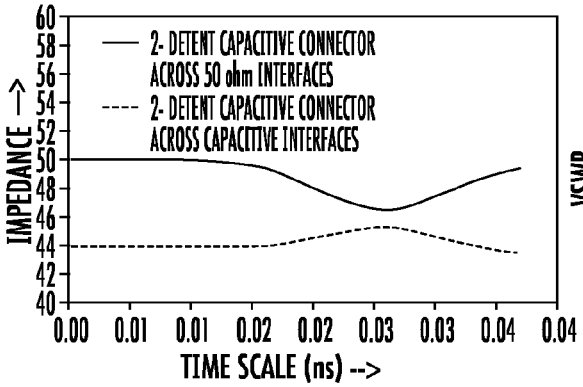
FIG. 11 is a graph illustrating a simulation of a TDR sampling for the connector interface across 50 ohm and capacitive interfaces, such as that of FIGS. 9 and 10.
Figure 12:
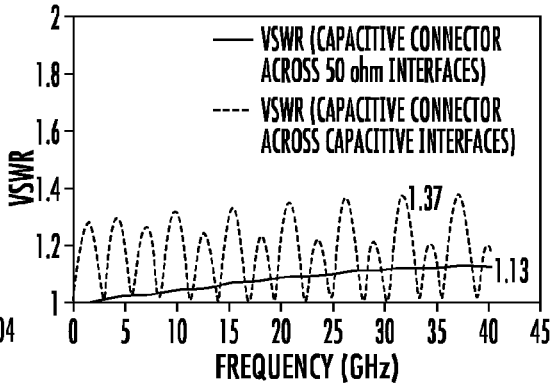
FIG. 12 is a graph illustrating the effect of the interfaces in FIG. 11 on the VSWRs.

FIG. 12 illustrates the projected improvement of VSWR from 1.67 (in FIG. 2) to 1.37 using connector interfaces such as 200' for capacitive interfaces having an impedance variation within the connector interface as shown by the TDR impedance (lower) profile in FIG. 11.

FIG. 12 also illustrates the projected VSWR result of 1.13 at 40 GHz when a connector interfaces such as 200, is employed to mate with 50 ohm interfaces having an impedance variation within the connector interface as shown by the TDR impedance (upper) profile in FIG. 11.

Figure 13:
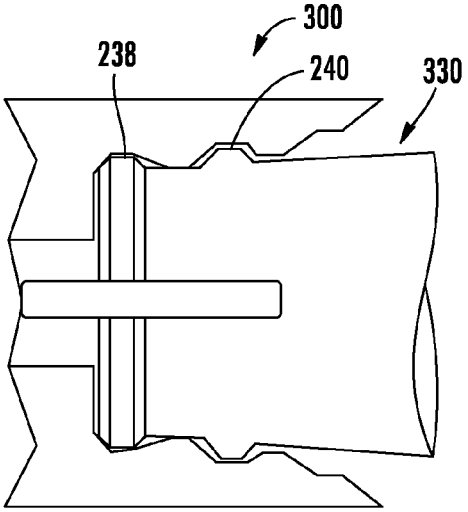
FIG. 13 is partial cross section view of a variable impedance coaxial connector interface device according to an exemplary embodiment with the coaxial conductor having a second radially outward projection to engage a second groove.

An alternative embodiment of an interface device 300 is illustrated in FIG. 13. In this embodiment, the coaxial connector 330 is similar to the coaxial connectors in the other embodiments, but has a first radially outward extending projection 238 and a second radially outward extending projection 240. It should be noted that in this embodiment as well as the other embodiments, the radially outward extending projections do not have to be continuous, uninterrupted, or completely encircle the front ends of the coaxial connectors. In this embodiment, the coaxial connector 330 engages both grooves in the shroud to provide even more mechanical strength in the engagement between the two components.

Figure 14:
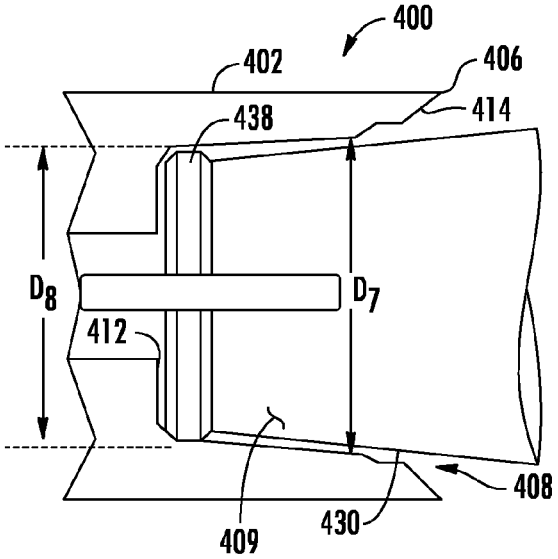
FIG. 14 is partial cross section view of a variable impedance coaxial connector interface device according to an exemplary embodiment with the shroud having a smooth internal surface for varying the impedance of the interface device.

FIG. 14 illustrates another embodiment of an interface device 400 with a shroud 402. The shroud 402 has an internal surface 414 in cavity 409 that extends from opening 408 at the cavity first end 406 to the cavity second end 412. The opening has first diameter D7 near the cavity first end 406 and a second diameter D8 at the cavity second end 412. The diameter D7 is larger than the diameter D8, thereby causing the cavity 209 to decrease towards the cavity second end 412. When a coaxial connector 430 is inserted into the opening 408, the radially outward extending projection 438 engage the internal surface 414 of the cavity 409 anywhere between the cavity first end 406 and the cavity second end 412. The user or designer may therefore change the impedances of the interface device by the location of the coaxial connector 430 within the cavity 409 of the shroud 402.

Figure 15:
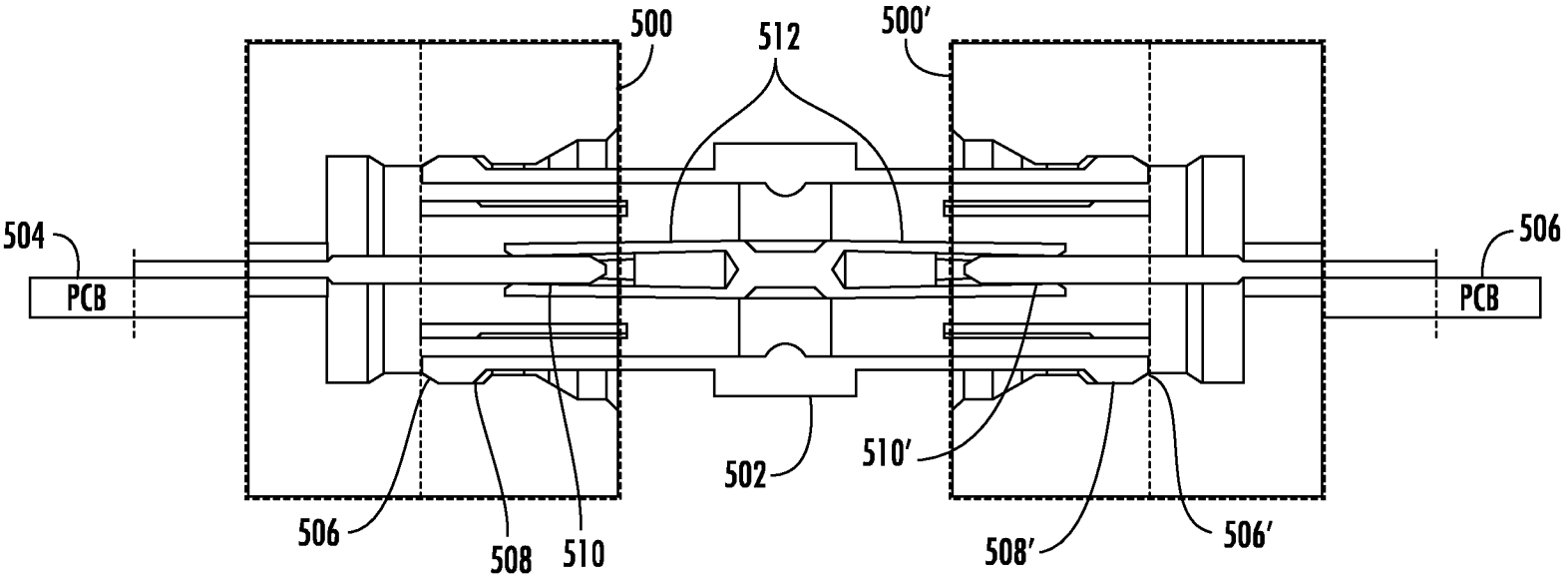
FIG. 15 is a cross section view of two variable impedance coaxial connector interface devices used to connect a coaxial connector to two respective printed circuit boards.

Referring now to FIG. 15, there is illustrated two interface devices 500, 500' with a coaxial connector 502 inserted into each interface device 500, 500'. The interface device 500 is connected to PCB 504 and provides an interface connection between the coaxial connector 502 and the PCB 504. A first front end 506 of the coaxial connector 502 is disposed in and releasably retained by first groove 508 of the interface device 500. A second front end 506' of the coaxial connector 502 is disposed in and releasably retained by a first groove 508' of the interface device 500'. A central conductor 510 of the interface device 500 mechanically and electrically connect to inner conductor 512 of the coaxial connector 502. Similarly, a central conductor 510' of the interface device 500' mechanically and electrically connect to inner conductor 512 of the coaxial connector 502. The interface device 500 and the interface device 500' may be designed for particular impedances at their respective first grooves 508, 508' to accommodate the impedances of the PCB's 504 and 506 respectively. In this manner, the coaxial connector 502 can connect two PCBS 504, 506 using interface devices 500, 500' each with impedance characteristics to provide for an appropriate connection at the interfaces with the PCBs 504, 506 without unacceptable signal degradation.

Many modifications and other embodiments not set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims and their equivalents. Although specific terms are employed herein, they are used in a generic and descriptive sense only and not for purposes of limitation.

We claim:

1. A variable impedance interface device for connecting a coaxial connector to an external component, the device comprising:

a housing having a first end adapted to receive a coaxial connector and a second end having an interface, wherein the housing is attachable to an external component at the interface;

a cavity within the housing and defined by an inner surface, the cavity having a cavity first end and a cavity second end, the cavity first end having a first diameter, and the cavity second end having a second diameter, the inner surface tapering from the first diameter to the second diameter;

an opening for receiving a coaxial connector at the cavity first;

a center conductor extending into the housing from the second end and toward the first end and into the cavity, wherein the center conductor is electrically insulated from the housing by a dielectric; and a plurality of mating positions in the cavity, a first of the plurality of mating positions having a first certain dimension defined by the taper of the inner surface, and a second of the plurality of mating positions having a second certain dimension defined by the taper of the inner surface, the second certain dimension different than the first certain dimension, wherein each of the plurality of mating positions defines a location at which the coaxial connector received by the housing positions, and wherein an impedance of the housing varies from the first of the plurality of mating positions to the second of the plurality of mating positions.

2. The device of claim 1, wherein the inner surface tapers radially inwardly.

3. The device of claim 1, wherein the impedance of the housing is based on impedance at the interface, such that signal degradation at the interface is reduced.

4. The device of claim 1, wherein the impedance of the housing varies based on the location of the mating position.

5. The device of claim 1, wherein the impedance of the housing varies based on the dimension of the mating position.

6. The device of claim 3, wherein the dimension of the mating position is a diameter of the mating position.

7. The device of claim 1, wherein the impedance of the housing varies based a diameter of the center conductor.

8. The device of claim 1, wherein the impedance of the housing varies based on a diameter of the dielectric.

9. The device of claim 1, wherein the impedance of the housing varies based on material composing the dielectric.

10. The device of claim 1, wherein the housing has a different impedance at each of the plurality of mating positions.

11. The device of claim 1, wherein the mating position has a structural feature in the form of a groove extending radially outwardly from the inner surface of the cavity.

12. The device of claim 11, further comprising a first groove and a second groove.

13. The device of claim 12, wherein the housing has a first impedance at the first groove and a second impedance at the second groove.

14. The device of claim 1, wherein the dielectric is composed of one or more of air, teflon, torlon and glass.

15. The device of claim 1, wherein the first of the plurality of mating positions is located at the cavity first end, and the second of the plurality of mating positions is located at the cavity second end.

16. The device of claim 15, wherein the inner surface tapers from the cavity first end to the cavity second end.

17. The device of claim 15, wherein the inner surface is smooth from the cavity first end to the cavity second end.

* * * * *